US012084251B2

(12) United States Patent
Grandy et al.

(10) Patent No.: US 12,084,251 B2
(45) Date of Patent: Sep. 10, 2024

(54) HOLDER ASSEMBLY FOR BOTTLES AND CONTAINERS

(71) Applicant: Grand Marlin Capital, LLC, Jacksonville, FL (US)

(72) Inventors: Jared Peter Grandy, New Era, MI (US); Zachary Henry Valdez, Kentwood, MI (US); Robert Brady, Sarasota, FL (US); Joel Raymond Chartier, Blowing Rock, NC (US); Matthew William Vergin, St. Petersburg, FL (US)

(73) Assignee: Grand Marlin Capital, LLC, Jacksonville, FL (US)

( * ) Notice: Subject to any disclaimer, the term of this patent is extended or adjusted under 35 U.S.C. 154(b) by 40 days.

(21) Appl. No.: 18/191,900

(22) Filed: Mar. 29, 2023

(65) Prior Publication Data

US 2023/0312212 A1 Oct. 5, 2023

Related U.S. Application Data

(60) Provisional application No. 63/325,165, filed on Mar. 30, 2022.

(51) Int. Cl.
*B65D 77/24* (2006.01)

(52) U.S. Cl.
CPC ..... *B65D 77/245* (2013.01)

(58) Field of Classification Search
CPC ..... B65D 77/245
(Continued)

(56) References Cited

U.S. PATENT DOCUMENTS 2,738,900 A * 3/1956 Wenger ..... B65D 51/246 215/DIG. 5
7,464,475 B2 * 12/2008 Tsao ..... B65D 77/245 248/213.2

(Continued)

FOREIGN PATENT DOCUMENTS

| | | |
|---|---|---|
| JP | 2006335378 | 12/2006 |
| JP | 2011131891 | 7/2011 |
| WO | WO2017155453 | 9/2017 |

OTHER PUBLICATIONS

United States Patent Office; International Search Report and Written Opinion for PCT/US2023/065081; Jul. 21, 2023; entire document.

*Primary Examiner* — Jacob K Ackun
(74) *Attorney, Agent, or Firm* — Allen, Dyer, Doppelt & Gilchrist, P.A.

(57) ABSTRACT

A holder assembly configured to hold a scoop within an inside of a container at a height above the level of a substance. The holder assembly comprises a first portion and a second portion. The first portion comprises a stem that may be provided with a height according to the geometry of the intended container. The second portion comprises a plurality of stems cooperatively configured and dimensioned to retain the scoop disposed in an inverted position. The segments are connected to the stem at a junction and should be disposed in a spaced apart relation to one another collectively defining a gap for the scoop wall(s). The segments should be movable away from the gap and comprise an inherent tendency to return to their natural position that generates a force that retains the scoop in place.

20 Claims, 6 Drawing Sheets

(58) Field of Classification Search
USPC ..... 206/229; 215/390, 391; 220/735, 752
See application file for complete search history.

(56) References Cited

U.S. PATENT DOCUMENTS

| | | | | |
|---|---|---|---|---|
| 8,215,167 | B2 | 7/2012 | Hall | |
| 8,302,805 | B2 * | 11/2012 | Blomdahl | B65D 51/247 215/390 |
| 8,308,008 | B2 | 11/2012 | Perry et al. | |
| 8,833,584 | B2 * | 9/2014 | Groubert | B65D 51/246 206/229 |
| 10,239,675 | B2 | 3/2019 | Choi et al. | |
| 2006/0025711 | A1 | 2/2006 | Bell et al. | |
| 2006/0237467 | A1 * | 10/2006 | Anderson | B65D 77/245 220/735 |
| 2009/0277902 | A1 | 11/2009 | Darflinger | |
| 2011/0315586 | A1 | 12/2011 | Horton et al. | |
| 2012/0187008 | A1 | 7/2012 | Gillingwater | |
| 2014/0299567 | A1 * | 10/2014 | Vogel | B65D 23/12 53/421 |
| 2016/0318676 | A1 | 11/2016 | Choi et al. | |
| 2017/0210507 | A1 | 7/2017 | Rule | |
| 2018/0155088 | A1 | 6/2018 | Vandamme et al. | |
| 2019/0055073 | A1 | 2/2019 | Lee | |

* cited by examiner

HOLDER ASSEMBLY FOR BOTTLES AND CONTAINERS

FIELD OF INVENTION

The present invention relates to the field of holders for scoops inside of bottles, bags, pouches, boxes, containers and other related items.

BACKGROUND

Various nutritional products may be provided in powder and/or granular form such that they may be mixed with a liquid such as water or milk to create a beverage, including a nutritional beverage, thirst quenching beverage, etc. Although this may save space and extend the intended life of the nutritional substance, there are some associated drawbacks. For example, products provided in powder or other related form need to be removed from their container with other implements such as spoons or scoops. Accordingly, and while some products may be provided with a spoon and/or scoop on an inside of their container, such scoops and/or spoons may fall to the bottom of the substance such that it is cumbersome to remove them. For example, a user may need to place his/her hand on the inside of the container to remove the spoon or scoop from the substance. Not only does this cause an inconvenience as it may soil or otherwise dirty the user's hand(s), but it also may introduce moisture, dirt, grease, sweat, and/or other unwanted particles or contaminants into the container and/or the nutritional substance. In addition, this cumbersome exercise involves spending additional time to retrieve the spoon or scoop from the container.

Due to the foregoing drawbacks, there is a need in the industry to provide for a solution that allows for an easy and clean retrieval of a scoop from a container. Such a solution may involve scoop holder with a sufficiently long stem that can hold the scoop holder in a substantially vertical position above the level of surface of the substance within a container. A benefit would be realized if such a scoop holder were provided with a plurality of segments that could collectively form a gap where the wall(s) of the scoop may be inserted in an inverted position. An even further benefit would be realized by providing a scoop holder that is configured and dimensioned to hold the scoop above the vertical level of the surface of the substance. Even further benefits would be realized if such a scoop holder comprised a plurality of rounded portions disposed at the ends of the segments that would facilitate placement of the wall(s) of the scoops within the gap of the segments.

SUMMARY

The present invention is directed towards a holder assembly that may be used to retain and/or maintain a scoop within an inside of a container, including at a height that is above the level of the surface of the substance inside the container. The holder assembly generally comprises a second or bottom portion and a first or top portion. The second or bottom portion may be manufactured comprising various sizes, but should generally comprise a length is at least the height of the level of the surface of the substance inside of the container. The first or top portion may comprise a plurality of segments connected to the stem at a junction. The segments should be disposed in a spaced apart relation to one another collectively defining a gap, which is where the wall(s) of the scoop will be inserted, i.e., upside down. However, another part of the scoop, e.g., the stem or handle, may also be inserted into the gap such that the holder assembly may be used as an extension of the hand of the user. It is contemplated that the segments should be movable away from the gap, but that they should comprise an inherent tendency to return to their initial and natural position, such that they can generate a force that may grip and/or retain the scoop in place.

The segments may comprise corresponding projections on their outside to provide for enhanced stability. The projections may substantially extend along the height of the top portion, but may terminated on rounded portions. The rounded portions of the segments may collectively define a channel or funnel that at least partially facilitate insertion of the scoop into the gap. An interior flat surface or walls may be provided on an inner side of the segments and/or rounded portions to further facilitate insertion of the scoop. The holder assembly may be optionally provided with an attachment mechanism with a plurality of correspondingly dimensioned sockets and retaining elements disposed on the inner sides of the segments. The holder assembly may further comprise a leveling assembly disposed on the stem of the bottom portion to remove excess material from the scoop.

DETAILED DESCRIPTION

Figure 1:
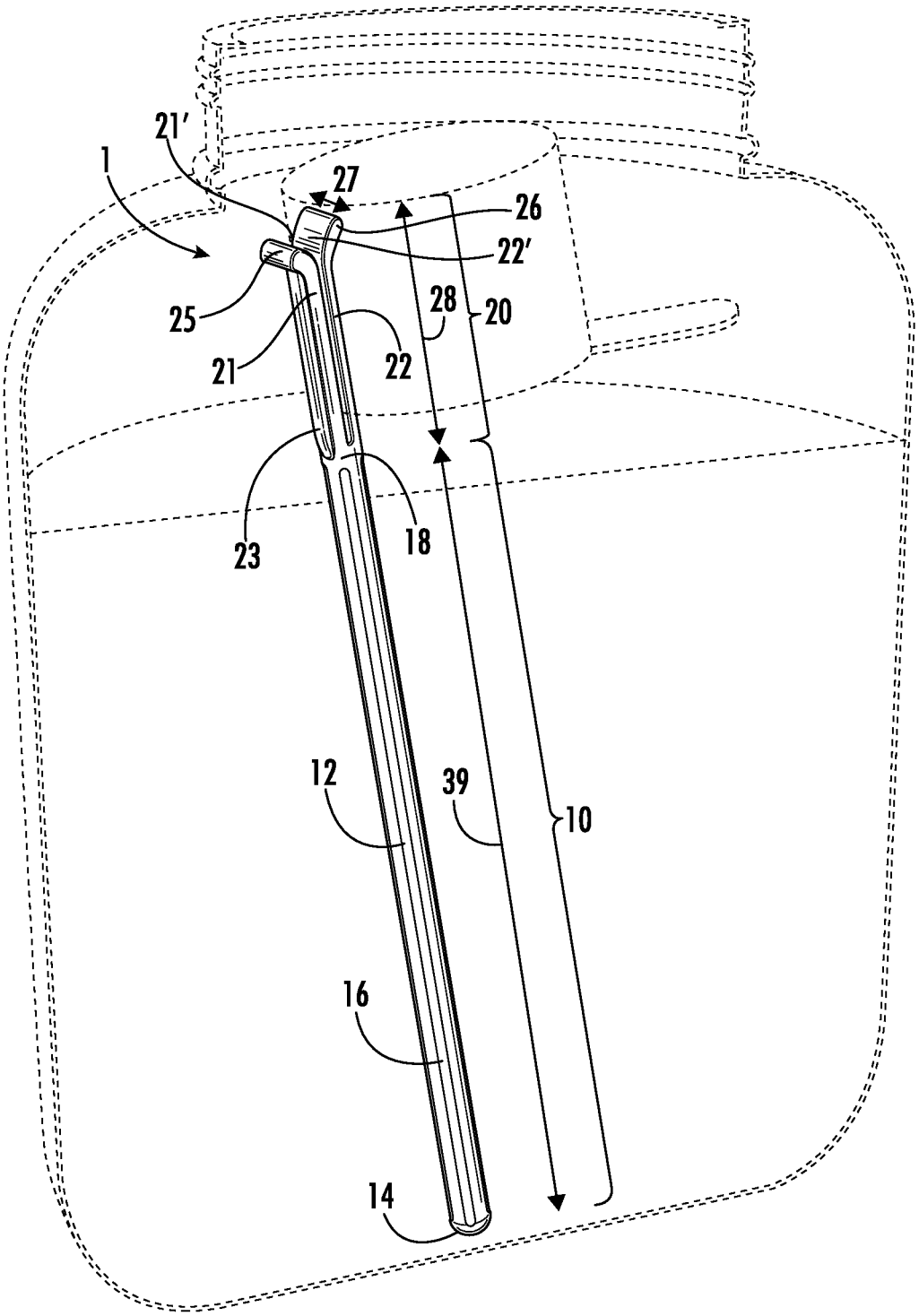
FIG. 1. is a perspective view of one embodiment of the holder assembly according to the present invention disposed on an inside of a container and retaining a scoop in an inverted position.

With initial reference to FIGS. 1-8, the present invention is directed towards a holder assembly 1 for use in connection with bottles, containers, boxes, bags, pouches and other related items that can store a substance in a powder, granular, or other related form. For example, the innovative holder assembly 1 may be used in connection with bottles or containers that may be provided with a scoop to remove the substance from the inside of the bottle or container. As used herein, the term "container" may refer to, and may be used interchangeably with, any one of various bottles, boxes, bags, containers, or other related items that may store a powered or granular substance. Also as used herein, the term "substance" generally refers to a substance that is provided in a powder form, granular form, or other related form and that may be stored inside of a container. Accordingly, and as is shown at least in FIG. 1, it is contemplated that the innovative holder assembly 1 may be disposed on an inside of a container and may be used to hold a scoop to remove the substance from the container. For example, the holder assembly 1 may be used to attach a wall of the scoop or a stem of the scoop and use it as an extension to retrieve an amount of substance from the bottle or container.

With reference again to FIGS. 1-4 and 6-8, the holder assembly 1 comprises a first portion 20, which may be disposed around a top or upper part of the holder assembly 1. As also shown in FIGS. 1-4 and 6-8, the holder assembly 1 also comprises a second portion 20, which may be disposed around a bottom or lower part of the holder assembly 1. The second portion 10 is intended to serve as a support and/or extension for the first portion 20. Accordingly, the second portion 10 may comprise a height 39, which may be variable, and may depend on the dimensions of the container, including height, diameter, width, etc. As may be appreciated from FIG. 1, the height 39 of the second portion 10 may be at least equal to the height or vertical level of the surface of the substance when disposed inside of the container. The height 39 of the second portion 10 should also be a minimum such that if the holder assembly 1 is disposed at an inclined position, the first portion 20 should also remain at least partially or fully above the height or vertical level of the surface of the substance. Thus, the second portion 10 may comprise a stem 12, which may comprise a dimension that corresponds to the size of the inside of the inside of the container. The stem 12 may comprise a substantially elongated shape and/or a substantially cylindrical, or semi-cylindrical configuration. Optionally, the stem 12 may comprise at least one indentation or groove 26 that substantially extends along the height 39 of the second portion 10. Furthermore, the second portion 10 may be provided with a tip 14, which may comprise a plurality of shapes and/or sizes, and as shown in FIGS. 1-4 and 6-8, may be provided with a substantially round configuration to enable various inclined positions of the stem 12.

It is within the scope of the present invention that the holder assembly 1 may be used not only to maintain the scoop substantially above the level of the surface of the substance, but also to serve as an extension to the hand of a user. That is, it contemplated that a user may manually grab the stem 12 of the holder assembly 1, while the scoop is being retained by the segments, e.g., 21 and 22, and use the holder assembly 1 as an extension of the scoop to physically remove amounts of the substance from the container. Alternatively, the segments, e.g., 21 and 22, may also retain a stem of the scoop. This is a beneficial use of the holder assembly 1 that avoids having to manually grab the scoop and insert the hand and/or a portion of the user's arm into the container to remove an amount of the substance. In addition, such use of the holder assembly 1 and the scoop, facilitates an efficient process as the scoop does not need to be removed form, and reinserted into, the holder assembly 1 to remove the substance from the container. Said differently, the holder assembly 1 may be used to remove substance from the container when it retains the scoop, e.g., as shown in the illustrative embodiment of FIG. 1.

As seen in FIGS. 1-4 and 6-8, the second portion 10 and first portion 20 may intersect at a common point or junction 18. Generally, the holder assembly 1 according to the present invention may be provided comprising a plurality of segments. As is perhaps best shown in FIG. 4, two different segments 21 and 22 may be formed, disposed on, or otherwise connected to the stem 12 above and/or at the junction 18. The segments 21 and 22 may comprise a substantially equivalent structure and should be disposed in a spaced apart relation with respect to one another. It is contemplated that the spaced apart relation of the segments 21 and 22 should be maintained around the majority and/or entirety of the first portion 20. If more than two segments are provided, they may be disposed in spaced apart relation to one another in a concentric fashion around the stem 12. The spaced apart relation of the segments, e.g., 21 and 22 should substantially define a gap 29 that should comprise a thickness that is at proximately the same as the thickness of the actual scoop that will be held by the holder assembly 1. As is perhaps best shown on FIG. 4, corresponding pairs of segments 21 and 22 should collectively define a gap 29 that substantially extends at least along a portion of their height, i.e., 28. The gap 29 should approximately span from around the junction 18 to the point where the rounded portions 25 and 26 are defined. Further, the gap 29 may assume a substantially tapered profile or otherwise substantially conical around the rounded portions 25 and 26, which is herein referred to as an aperture 29' of the first portion 20.

Figure 2:
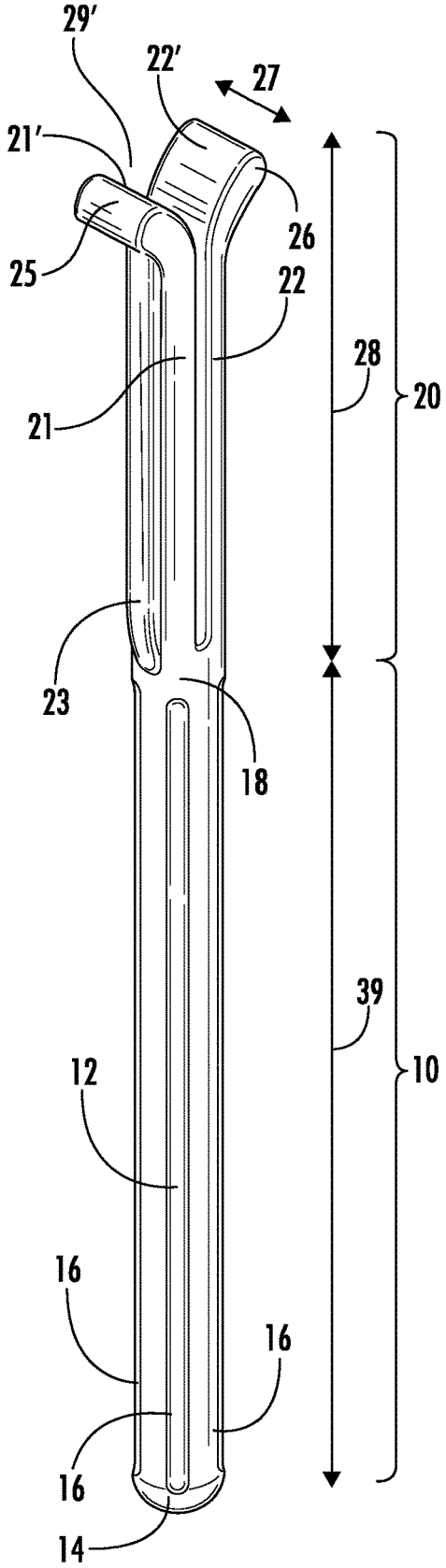
FIG. 2. is a perspective view of another embodiment of the holder assembly according to the present invention.
Figure 3:
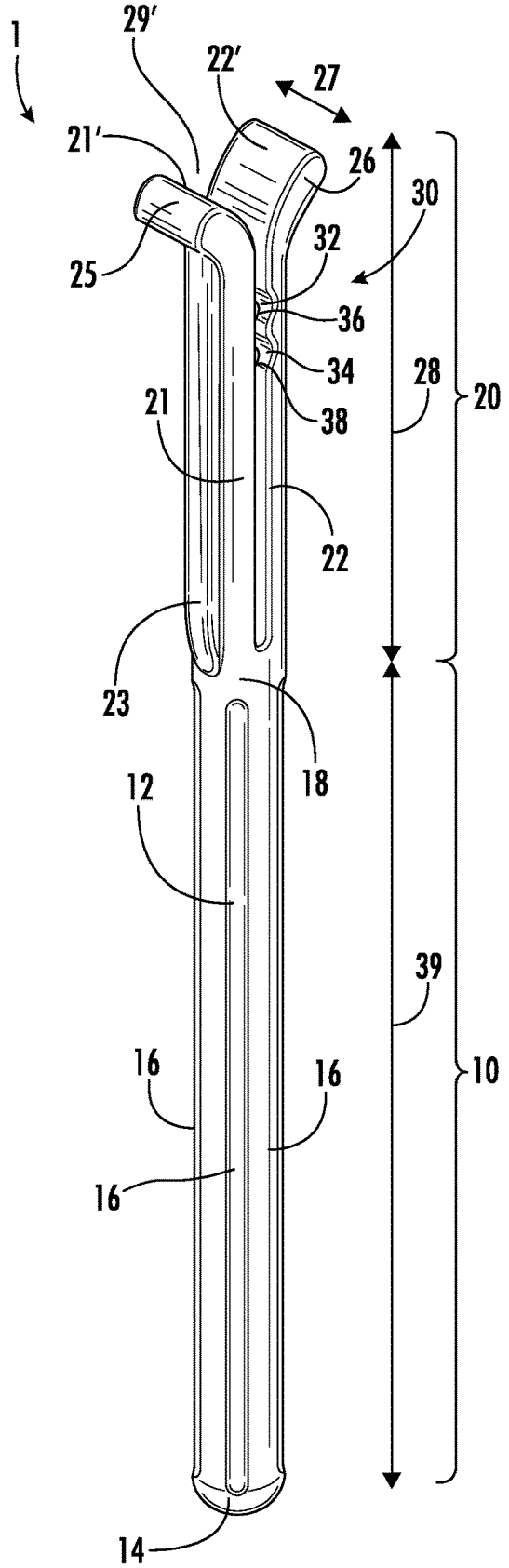
FIG. 3. is a perspective view of yet another embodiment of the holder assembly according to the present invention comprising an attachment mechanism.
Figure 4:
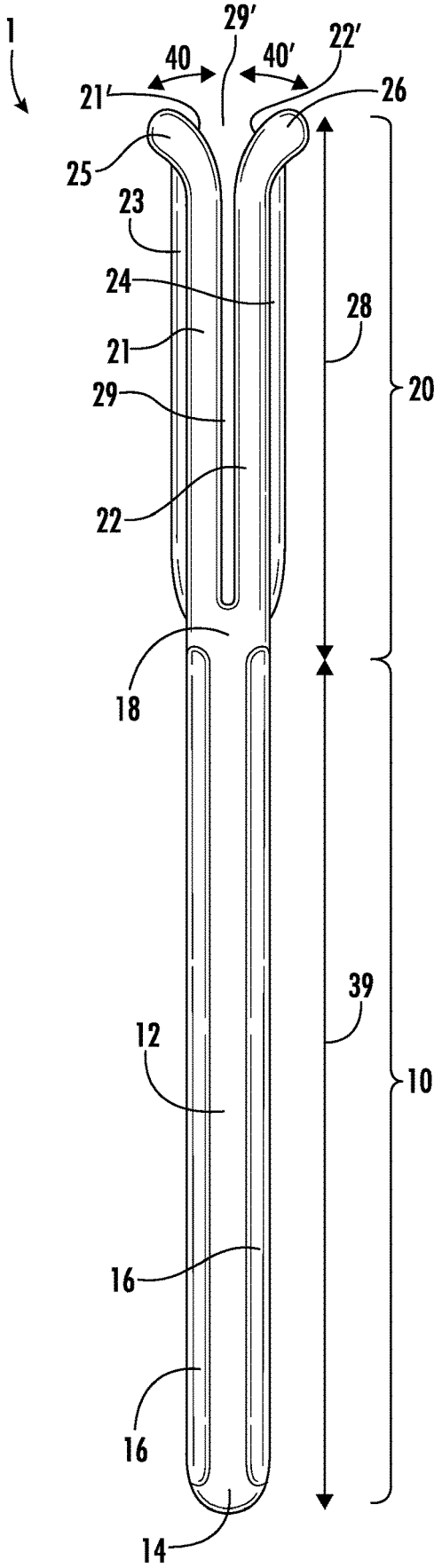
FIG. 4. is a front view of an even further embodiment of the holder assembly according to the present invention.
Figure 5:
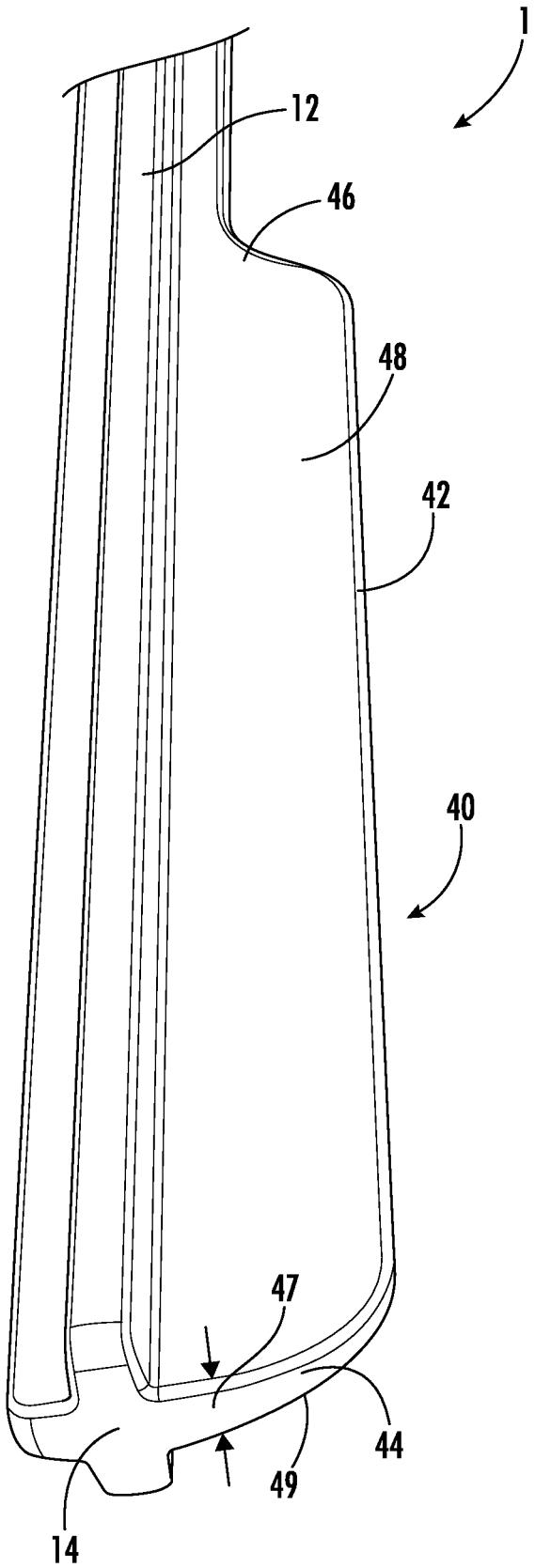
FIG. 5 is a perspective view of a portion of one embodiment of the holder assembly according to the present invention comprising a leveling assembly disposed on the stem.

It is also contemplated that both the first portion 20 and the second portion 10 should comprise a substantially equivalent material that comprises some flexibility around the junction 18. As such, it is contemplated that the segments, e.g., 21 and 22, should be malleable, flexible, or otherwise pliable, such that they may move away and towards the gap 29, e.g., in the directions represented at 40 and/or 40'. Thus, the material of the segments, e.g., 21 and/or 22 may comprise a plastic, polymer, or other related material, that is sufficiently pliable or flexible to allow the segments, e.g., 21 and/or 22, to bend away from the gap 29, i.e., by the force of the scoop when it is inserted around the gap 29 or the force of the fingers of a user that move the segments, e.g., 21 and/or 22, away from the gap 29. The material of the segments, e.g., 21 and/or 22 should also comprise a resistance that provides the segments, e.g., 21 and/or 22, with an inherent tendency to move back to their original positions, i.e., as shown in FIG. 4, and as such the segments should act as retainers to the scoop and can hold it in a desired position inside of the container. However, the embodiments as shown in FIGS. 1-3 and 6-8, which show substantially straight segments 21 and/or 22, are not necessarily limiting given that other shapes of the segments are also contemplated, including curved, elliptical, etc.

Further features of the present invention comprise providing a holder assembly 1 with a plurality of projections, each one disposed on corresponding ones of the plurality of segments. For example, as shown in FIGS. 1-4 and 6-8, projections 23 and 24 disposed on the segments 21 and 22 to at least partially provide for an enhanced structural integrity. The projections, e.g., 23 and/or 24 are intended to serve as structural reinforcement to the segments, e.g., 21 and/or 22. It is contemplated that the holder assembly 1 according to the present invention may go through several cycles of movements of the segments, e.g., 21 and 22, away from and towards the gap 29. In turn, and depending on the material of the segments, e.g., 21 and 22, and/or stem 12, this may induce some fatigue, which may create some weakness points around the junction 18 and/or around the bottom areas of the segments, e.g., 21 and 22, including where they connect to the stem 12 around the junction 18. Accordingly, as shown in FIGS. 1-3, the projections 23 and/or 24 may be respectively disposed on the outside part of the segments, e.g., 21 and/or 22. Further, the projections 23 and/or 24 may comprise a substantially curved or tapered configuration around the junction 18, e.g., to facilitate handing and/or insertion into the substance inside the container. As may be best appreciated from FIG. 4, the projections 23 and/or 24 may follow a substantially similar profile than the segments, e.g., 21 and/or 22, i.e., they may run substantially parallel to the height 28 of the segments, e.g., 21 and/or 22.

Additional features of the present invention comprise providing a plurality of rounded portions disposed on an end of corresponding ones of the plurality of segments. With reference again to FIGS. 1-4 and 6-8, each one of the segments 21 and/or 22 may substantially define a rounded portion 25 and/or 26. The rounded portions, e.g., 25 and/or 26, are intended to collectively define a funnel that facilitates and/or directs insertion of the wall(s) of a scoop into the gap 29. As is represented in FIG. 4, the gap 29 may comprise a height that is substantially equivalent to the height of the wall(s) of the scoop, such that the segments 21 and 22 may hold the scoop in place and so that the scoop does not detach and end below the substance on the inside of the container. Moreover, and as is perhaps best represented in FIG. 4, the projections 23 and/or 24 may substantially extend along the height 28 of the first portion 20, and may also substantially merge into the rounded portions 25 and/or 26. As such, it is contemplated that the collective geometry of the rounded portions 25 and/or 26 should facilitate insertion of the walls or stem of the scoop into the gap 29. In addition, as is represented in the illustrative embodiments of FIGS. 1-3 and 6-8, each one of the segments, 21 and/or 22, as well as their rounded portions 25 and/or 26 should comprise a minimum thickness 27 that allows for the segments engage the scoop. The minimum thickness 27 should also at least partially reduce movement of the scoop with respect to the holder assembly 1 on the inside of the container and/or within the substance.

With reference to FIGS. 1-3 and 6-8, features of the present invention comprise providing a first portion 20 with flat surfaces disposed on the interior or interior side of each one of the plurality of segments. For example, as shown in the illustrative embodiments of FIGS. 1-3 and 6-8 a flat surface 21' may be disposed on the interior side of the first segment 21, and a second flat surface 22' may be disposed on the interior side of the second segment 22. The flat surfaces 21' and/or 22' may comprises a substantially equivalent structure and/or dimensions, such that both may collectively define the dimensions of the gap 29. The flat surfaces 21' and/or 22' may also comprise a thickness, which may substantially equivalent to the thickness 27 of the corresponding segment 21 and/or 22. Further, each flat surface 21' and/or 22' may cover not only the interior or interior side of a corresponding segment 21 and/or 22, but as is perhaps best shown in FIGS. 4 and 6-8, they may also cover at least a portion of a corresponding rounded portion 25 and/or 26. That is the flat surface 21' and/or 22' may extended around each rounded portion such that the aperture 29' also comprises a thickness that is the substantial equivalent to the thickness 27.

With reference now to FIG. 3, further features of the present invention comprise providing an optional attachment assembly 30. The attachment assembly 30 may comprise a plurality of sockets i.e., 32 and/or 34, cooperatively configured and dimensioned with a plurality of retaining elements, i.e., 36 and/or 38, to provide for a mechanism that further assists in retaining and/or securing the scoop to the segments 21 and/or 22. As may be appreciated in FIG. 3, the retaining elements 36 and/or 38 may be disposed on the inside portion one of the segments, i.e., 21 and/or 22, and the plurality of sockets 32 and/or 34 may be disposed on the inside portion of the other segment, i.e., 22 and/or 21. Further, the retaining elements 36 and/or 38 should be disposed on the inside of the segments 21 and/or 22 at substantially the same height as their respective sockets 32 and/or 34. As such, it is contemplated that the scoop may also be manufactured and/or dimensioned with corresponding structures that facilitate attachment of the scoop at a desired position and that will work together with the plurality of sockets 32 and/or 34, and/or the retaining elements 36 and/or 38.

Figure 6:
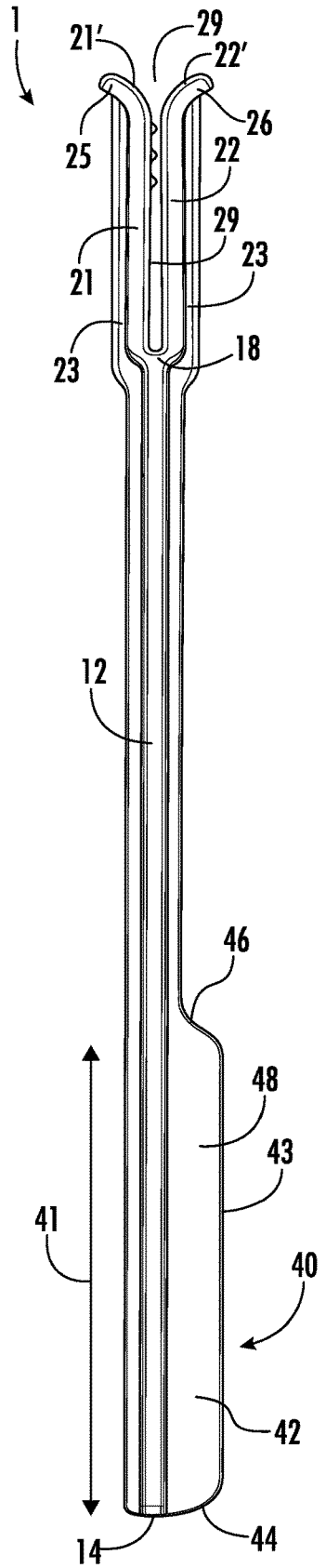
FIG. 6 is a front view of another embodiment of the holder assembly according to the present invention comprising a leveling assembly disposed on the stem.
Figure 7:
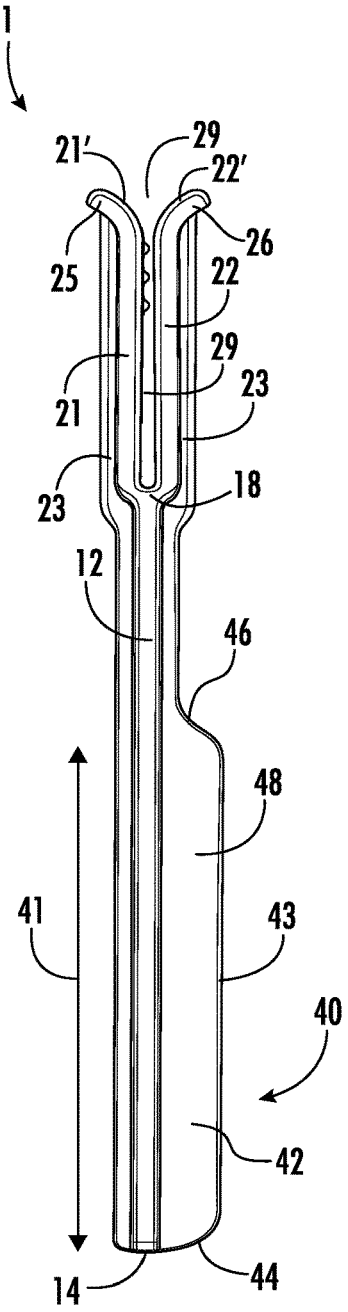
FIG. 7 is a front view of yet another embodiment of the holder assembly according to the present invention comprising a leveling assembly disposed on the stem.
Figure 8:
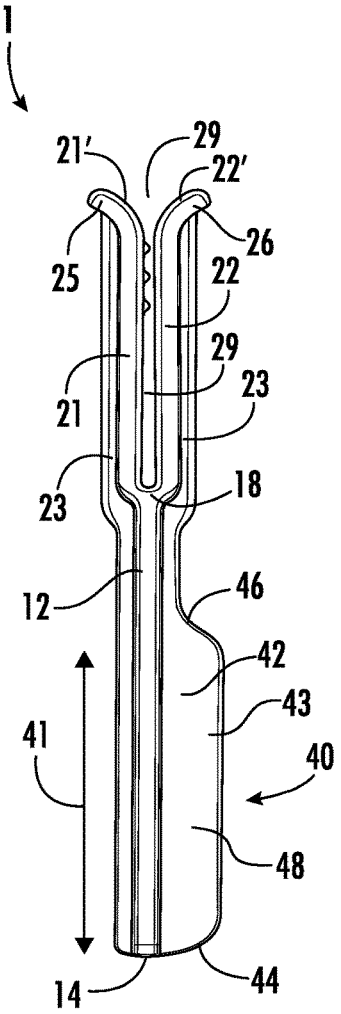
FIG. 8 is a front view of a further embodiment of the holder assembly according to the present invention comprising a leveling assembly disposed on the stem.

With reference to FIGS. 5-8, yet additional features of the present invention comprise providing a leveling assembly 40. The leveling assembly 40 is generally an optional ad-on feature that may assist the user in removing excess substance material from the scoop. The leveling assembly 40 generally comprises a body 42, which may be a flap, tab or other similar structure, disposed around the outside surface of the stem 12 along its height thereof. The body 42 may be disposed on the stem 12 in a substantially parallel direction thereto, e.g., as shown in FIGS. 6-7. The body may comprise a thickness that is less than the diameter or otherwise thickness of the stem 12. Further, the body 42 may comprise a height 41 that is at least a portion of the height 39 of the stem 12. The height 41 of the body 42 may be substantially equivalent to the height 41 of the stem 12. Further, as is perhaps best shown in FIG. 5, the leveling assembly 40 may comprise a leveling edge 43 disposed on a side of the body 42. The leveling edge 43 may comprise a dimension that is at least the diameter of the scoop such that it may be used to effectively remove excess material from the top. As an added feature, a rounded structure 46 may be disposed on a top edge of the body 42 to smoothly transition to the body of the stem. Additionally, as is perhaps best shown in FIG. 5, a bottom portion 44 may be configured and dimensioned with the tip 14 of the second portion 10 to collectively define a continuous round end of the stem 12 and/or second portion 10 of the scoop holder 1.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A holder assembly configured to retain a scoop inside of a container, the holder assembly comprising:

a first portion comprising a stem and a tip disposed around an end thereof, a second portion comprising a plurality of segments disposed in spaced apart relation to one another and collectively defining a gap around a middle section of the second portion, each one of the plurality of segments connected to the first portion around a junction, a plurality of projections, each one disposed around an outside of a corresponding one of a plurality of segments, a plurality of rounded portions, each one disposed around an end of a corresponding one of the plurality of segments, and the gap structured and dimensioned to retain a scoop inside of a container.

2. The holder assembly as recited in claim 1 further comprising a plurality of flat surfaces, each one extending on an interior of a corresponding one of the plurality of segments.

3. The holder assembly as recited in claim 2 wherein each one of the plurality of flat surfaces extends on an inside of a corresponding one of the plurality of rounded portions.

4. The holder assembly as recited in claim 3 wherein the plurality of flat surfaces collectively define an aperture around an end of the second portion.

5. The holder assembly as recited in claim 1 wherein each one of the plurality of projections comprises a height that is substantially equivalent to at least a portion of the height of a corresponding one of the plurality of segments.

6. The holder assembly as recited in claim 1 wherein the gap is configured and dimensioned to correspond to the thickness of the wall of the scoop or the thickness of a holder of the scoop.

7. The holder assembly as recited in claim 1 wherein the gap is configured and dimensioned to correspond to the height of the wall of the scoop.

8. The holder assembly as recited in claim 1 wherein the first portion comprises at least one groove disposed along a height of the stem.

9. The holder assembly as recited in claim 1 wherein each one of the plurality of segments is structured to bend in a direction away from the gap and to return substantially to a position before bending.

10. The holder assembly as recited in claim 1 wherein the stem comprises a substantially cylindrical shape, a thickness of each one of the plurality of flat surfaces being substantially equivalent to a diameter of the stem.

11. A holder assembly configured to retain a scoop inside of a container, the holder assembly comprising:

a first portion comprising a stem and a tip disposed around an end thereof, a second portion comprising a first segment and a second segment disposed in spaced apart relation to one another and collectively defining a gap, each one of the first segment and the second segment connected to the first portion around a junction, a first projection disposed around an outside of the first segment, a second projection disposed around an outside of the second segment, a first rounded portion disposed around an end of the first segment, a second rounded portion disposed around an end of the second segment, and the gap structured and dimensioned to retain a scoop inside of a container.

12. The holder assembly as recited in claim 11 further comprising a first flat surface extending on an interior of the first segment and on an inside of the first rounded portion, a second flat surface extending on an interior of the second segment and on an inside of the second rounded portion.

13. The holder assembly as recited in claim 12 wherein the first flat surface and the second flat surface collectively define an aperture around an end of the second portion; the aperture comprising a substantially tapered configuration.

14. The holder assembly as recited in claim 12 further comprising a plurality of sockets disposed on the first flat surface around the first segment and a plurality of retaining elements disposed on the second flat surface around the second segment; the plurality of sockets configured and dimensioned with the plurality of retaining elements to collectively define a scoop attachment mechanism.

15. The holder assembly as recited in claim 11 wherein the first projection comprises a height that is substantially equivalent to a height of the first segment and the second projection comprises a height that is substantially equivalent to a height of the second segment.

16. The holder assembly as recited in claim 11 further comprises a leveling assembly disposed on the stem, the leveling assembly comprising a body with a height that is at least greater than a diameter of an opening of the scoop.

17. The holder assembly as recited in claim 16 wherein the leveling assembly comprises a leveling edge that is disposed substantially parallel a length of the stem; a thickness of the stem being greater than a thickness of the body of the leveling assembly.

18. The holder assembly as recited in claim 16 wherein the leveling assembly comprises a first portion configured and dimensioned with the tip to collectively define a round end of the first portion.

19. The holder assembly as recited in claim 16 wherein the leveling assembly further comprises a rounded structure disposed on an upper end of the body thereof.

20. A holder assembly configured to retain a scoop inside of a container, the holder assembly comprising:

a first portion comprising a stem and a substantially round tip disposed around an end thereof, a second portion comprising a first segment and a second segment disposed in spaced apart relation to one another and collectively defining a gap, each one of the first segment and the second segment connected to the first portion around a junction, a first projection and a second projection respectively disposed around an outside of the first segment and an outside of the second segment, each one of the first projection and the second projection comprising a height that is substantially equivalent respectively to a height of the first segment and a height of the second segment, a first rounded portion and a second rounded projection disposed respectively around an end of the first segment and an end of the second segment, a first flat surface extending on an interior side of the first segment and on the first rounded portion, a second flat surface extending on an interior side of the second segment and on the second rounded portion, each of the first segment and the second segment being structured to bend in a direction away from the gap about the junction and to automatically return original position before bending, the gap structured and dimensioned to retain a scoop inside of a container.

* * * * *